US006945139B1

(12) United States Patent
Johnson

(10) Patent No.: US 6,945,139 B1
(45) Date of Patent: Sep. 20, 2005

(54) OFFSET SOCKET DRIVE

(76) Inventor: Bobby R. Johnson, Rte. 4, Box 222A-1, Brewton, AL (US) 36426

( * ) Notice: Subject to any disclaimer, the term of this patent is extended or adjusted under 35 U.S.C. 154(b) by 0 days.

(21) Appl. No.: 10/668,307

(22) Filed: Sep. 22, 2003

(51) Int. Cl.[7] ..... B25B 17/00
(52) U.S. Cl. ..... 81/57.3; 81/57.14; 81/177.2
(58) Field of Search ..... 81/57.14, 57.3, 81/121.1, 124.4, 177.2, 180.1

(56) References Cited

U.S. PATENT DOCUMENTS

| | | | | | |
|---|---|---|---|---|---|
| 838,109 | A | * | 12/1906 | Hanes et al. | 81/124.4 |
| 845,717 | A | * | 2/1907 | Miller | 81/121.1 |
| 1,346,505 | A | | 7/1920 | Mitchell | |
| 1,423,142 | A | | 7/1922 | Owens | |
| 2,127,003 | A | * | 8/1938 | Nash | 81/57.14 |
| 2,482,387 | A | | 9/1949 | Veneman | |
| 2,830,479 | A | | 4/1958 | Finn | |
| 3,838,614 | A | * | 10/1974 | O'Donnell | 81/177.2 |
| 3,875,829 | A | * | 4/1975 | Evans et al. | 81/177.2 |
| 3,987,691 | A | | 10/1976 | Savage | |
| 4,063,475 | A | | 12/1977 | Perkins | |
| 4,287,795 | A | | 9/1981 | Curtiss | |
| 4,374,479 | A | * | 2/1983 | Minotti | 81/57.3 |
| 4,374,480 | A | | 2/1983 | Diaz | |
| 4,649,776 | A | | 3/1987 | Puncochar | |
| 4,825,729 | A | | 5/1989 | Puncochar | |
| 5,301,574 | A | * | 4/1994 | Knopp et al. | 81/57.24 |
| 5,438,894 | A | * | 8/1995 | Pearce | 81/177.2 |
| 5,732,605 | A | | 3/1998 | Mann | |
| 5,901,620 | A | * | 5/1999 | Arnold | 81/177.2 |
| 2004/0074344 | A1 | * | 4/2004 | Carroll | 81/121.1 |

* cited by examiner

*Primary Examiner*—James G. Smith
(74) *Attorney, Agent, or Firm*—Peter Loffler

(57) ABSTRACT

An offset socket drive has a body member with a drive gear that receives the drive head of an impact socket and a driven gear, gearably connected with the drive gear, The driven gear has a hollow core and receives that socket, which socket also has a hollow core that longitudinally aligns with the driven gear's hollow core. The socket may be directly received within the driven gear or may be received by a hex-to-square adapter or an extension system, each such additional devices also having a hollow core that longitudinally aligns with the driven gear's hollow core. A handle is removably and threadably attached to a desired position on the body member.

18 Claims, 6 Drawing Sheets

OFFSET SOCKET DRIVE

BACKGROUND OF THE INVENTION

1. Field of the Invention

The present invention relates to an offset socket driver that is gear driven and that has a drive gear that turns a driven gear, the driven gear having a hollow central core.

2. Background of the Prior Art

Impact drivers are used when working on various types of projects such as on vehicles, heavy machinery, and HVAC systems, for example. The impact driver, which is typically either electrical or pneumatic in operation, allows a user to tighten and loosen various bolts and nuts while offering the user a substantial mechanical advantage. Oftentimes, a nut needs to be tightened to a specific torque level and the use of an impact driver is all but necessary as a human simply lacks the strength to effectively achieve such a torque level, and even if the user can manually achieve such a level, in so achieving, the user expends a large reserve of strength and time, making manual tightening (or loosening) inefficient.

In many situations that call for the use of an impact driver, the nut or bolt to be loosened or tightened is located in very tight quarters, which tightness leaves insufficient room to insert and place an impact driver thereonto. In order to solve this problem and allow the use of an impact driver on an otherwise inaccessible nut or bolt, offset drives have been proposed. Such devices allow the drive head of the impact driver to be offset from the drive socket that is used on the nut or bolt. Typically, the drive head is received in a drive gear of the offset drive and the socket to be used is received in a driven gear that is laterally offset from the drive gear. Upon activation of the impact driver, its drive head rotates, which in turn rotates the drive gear. Rotation of the drive gear causes the driven gear to be rotated with the transfer of force between drive gear and driven gear typically being achieved by either a gear mesh transfer between gears or a chain that connects the two gears. Various arrangements of such devices are known and include gear ratio reduction and expansion configurations and allow a user to use an impact driver in areas that are otherwise inaccessible to the driver.

However, one area where such offset drives fail to offer the user a solution is where the nut to be tightened or loosened is located on a relatively long stud, for example a nut used on the leaf springs of a truck. The socket used with the driver is simply not deep enough to be able to be positioned on the nut. This problem is irrespective of whether or not the offset drive is used. In such situations, the nut must be manually loosened and tightened loosing the benefits of the impact driver.

Therefore, there exists a need in the art for an offset drive that allows a user to utilize an impact driver wherein the drive head of the driver is laterally offset from the driven socket and which offset drive addresses the above-stated problems in the art. Specifically, such an offset drive must allow the use of the impact driver on nuts that are positioned on a relatively long stud which stud is longer then the depth of the socket that is driven. Ideally, such an offset drive should be of relatively simple design and construction so that it is relatively inexpensive to manufacture and maintain. Such an offset drive should be versatile so that it can be used in almost all applications where the direct application of the impact driver is not possible.

SUMMARY OF THE INVENTION

The offset socket drive of the present invention addresses the aforementioned needs in the art. Specifically, the offset socket drive allows a user to utilize an impact driver where the direct application of the impact driver is not feasible and wherein the drive head of the driver is laterally offset from the driven socket. The offset socket drive allows the use of the impact driver on nuts that are positioned on a relatively long stud which stud is longer than the depth of the socket that is driven by the impact driver. The offset socket drive is of relatively simple design and construction making the device relatively inexpensive to manufacture and maintain. The present invention is sufficiently versatile, allowing it to be used in almost all applications where the direct application of the impact driver is not possible.

The offset socket drive of the present invention is comprised of a body member. A drive gear has a square recess that receives the drive head of an impact driver. The drive gear is rotatably disposed within the body member. A driven gear has a hex receptacle and is rotatably disposed within the body member and is gearably meshed with the drive gear. The driven gear has a first longitudinal hole core. An accessory has a second longitudinal core and is received within the hex receptacle such that the first hollow core and the second hollow core longitudinally align. The drive head of the impact driver is positioned within the drive recess and the impact driver is activated causing the drive head to rotate which causes the drive gear to rotate which in turn causes the driven gear and the received accessory to rotate. An oil fill opening may be located on an appropriate position on the body member for introducing oil into the body member and onto the drive gear and the driven gear for lubricating the gears. The square recess of the drive gear faces in an opposite direction relative to the hex receptacle of the driven gear. At least one threaded receptacle may be located on a side of the body member and a handle is threadably received within a respective one of the at least one threaded receptacle. A cap is threadably received within each of the threaded receptacles that does not receive the handle. The accessory comprises a socket. The socket may be received within the hex receptacle via a hex-to-square adapter that is received within the hex receptacle and the socket is received thereonto. The socket may be received within the hex receptacle via an extension. The extension comprises a hex-to-square adapter that is received within the hex receptacle, a hex drive adapter that is received on the hex-to-square adapter, and a first cylinder that is received on the hex drive adapter such that the socket is received by the cylinder. The extension may also comprise a coupler that attached to the first cylinder, and a second cylinder that is attached to the coupler such that the socket is received by the second cylinder. Additional couplers and cylinders are also possible.

BRIEF DESCRIPTION OF THE DRAWINGS

Similar reference numerals refer to similar parts throughout the several views of the drawings.

DESCRIPTION OF THE PREFERRED EMBODIMENT

Figure 1:
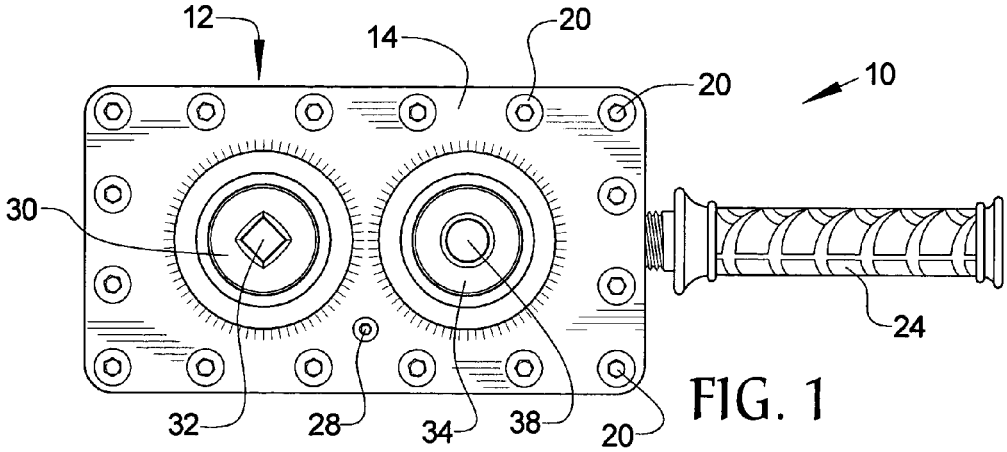
FIG. 1 is a top plan view of the offset socket drive of the present invention.
Figure 2:
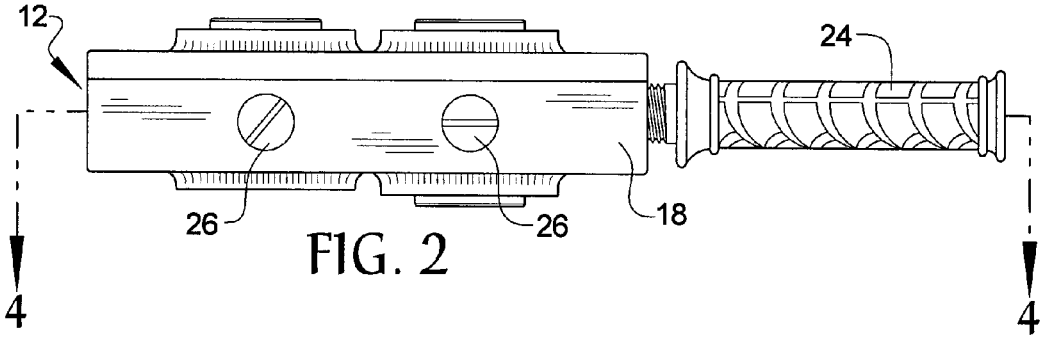
FIG. 2 is a side elevation view of the offset socket drive.
Figure 3:
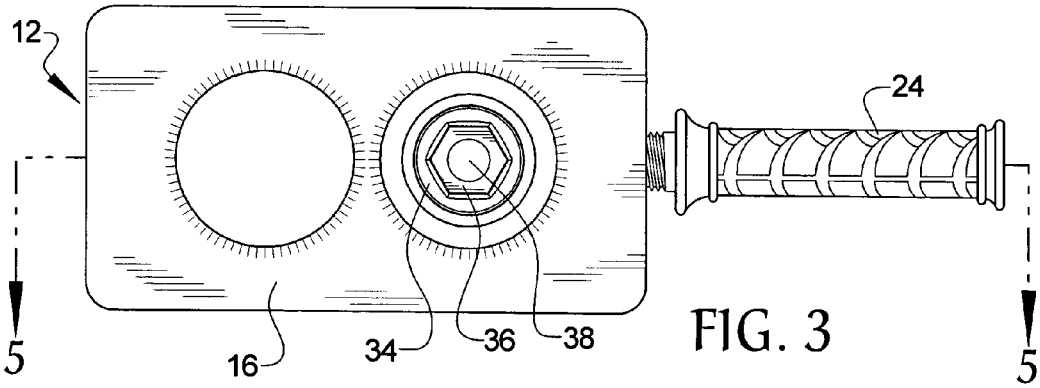
FIG. 3 is a bottom plan view of the offset socket drive.
Figure 4:
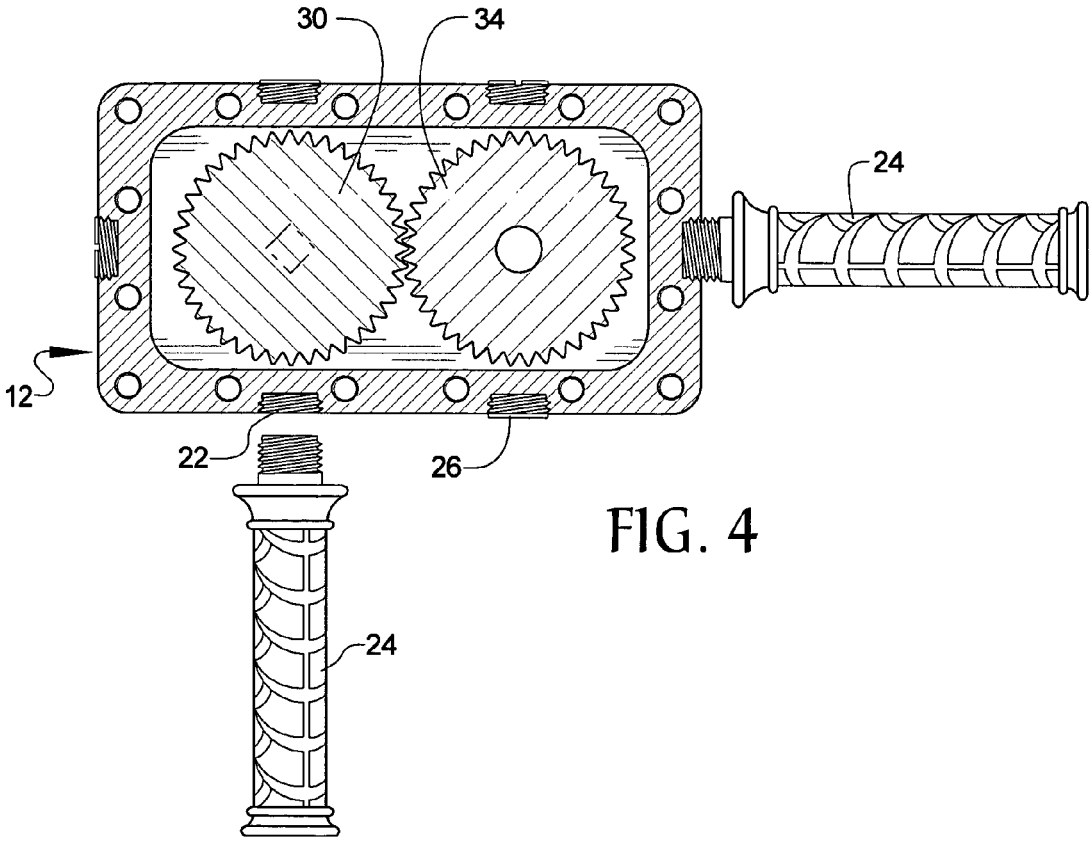
FIG. 4 is a sectioned view of the offset socket drive taken along line 4—4 in FIG. 2.
Figure 5:
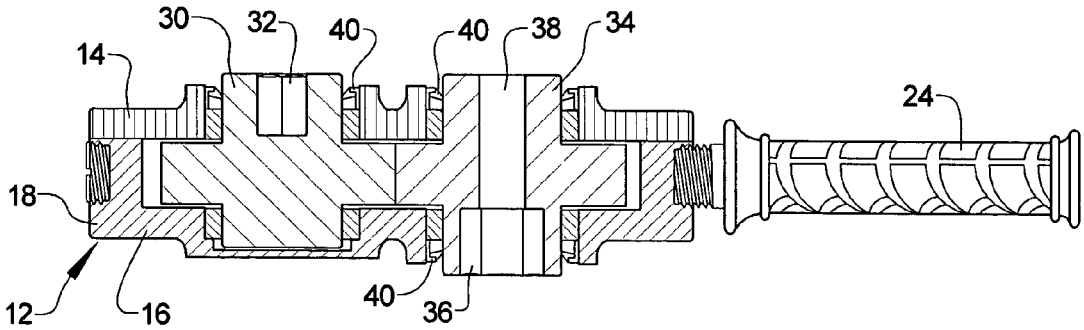
FIG. 5 is a sectioned view of the offset socket drive taken along line 5—5 in FIG. 3.
Figure 6:
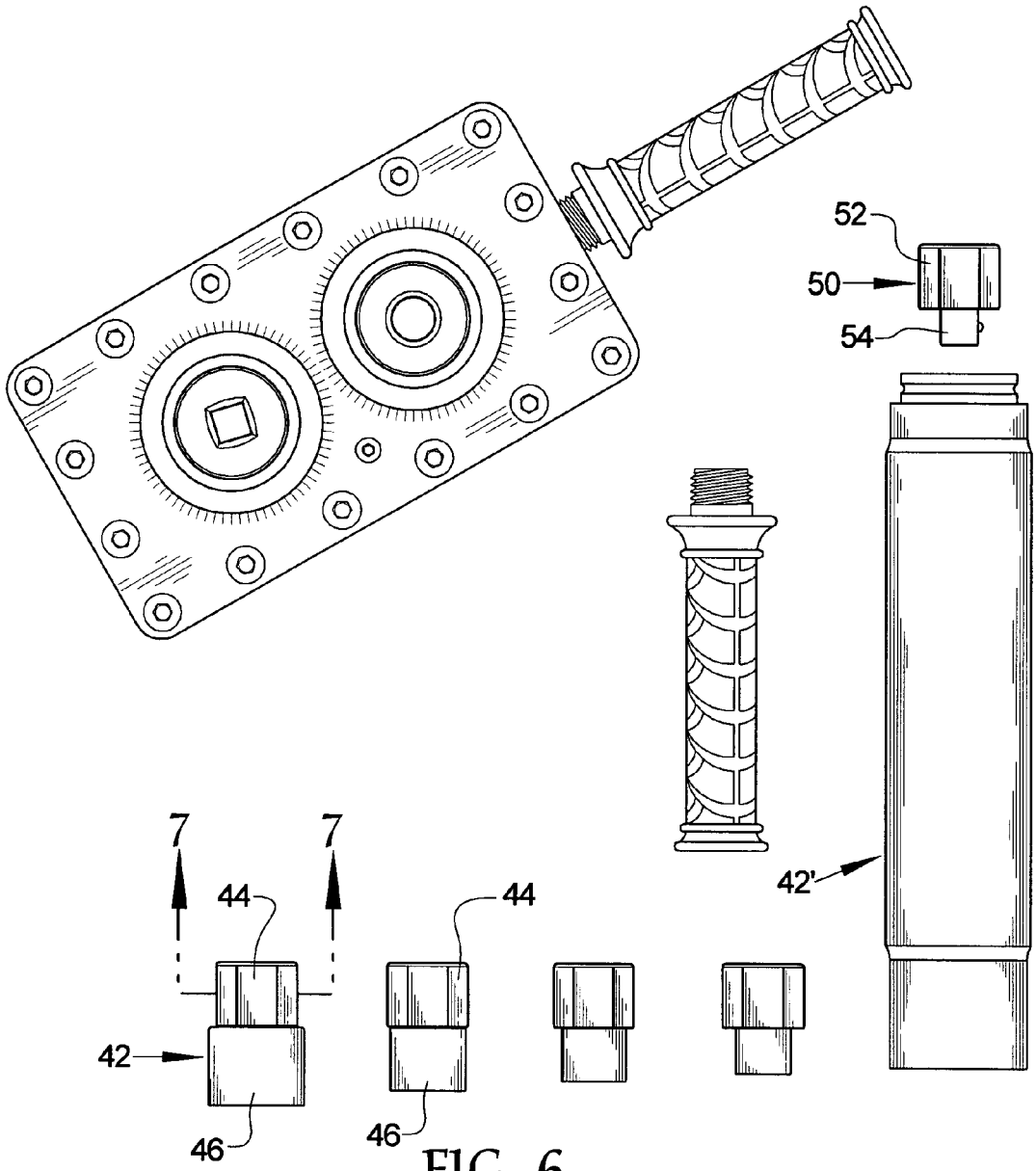
FIG. 6 is a perspective view of the various components of the offset socket drive.
Figure 7:
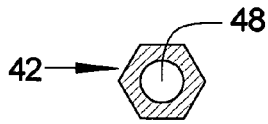
FIG. 7 is a sectioned view of a socket used by the offset socket drive taken along line 7—7 in FIG. 6.
Figure 8:
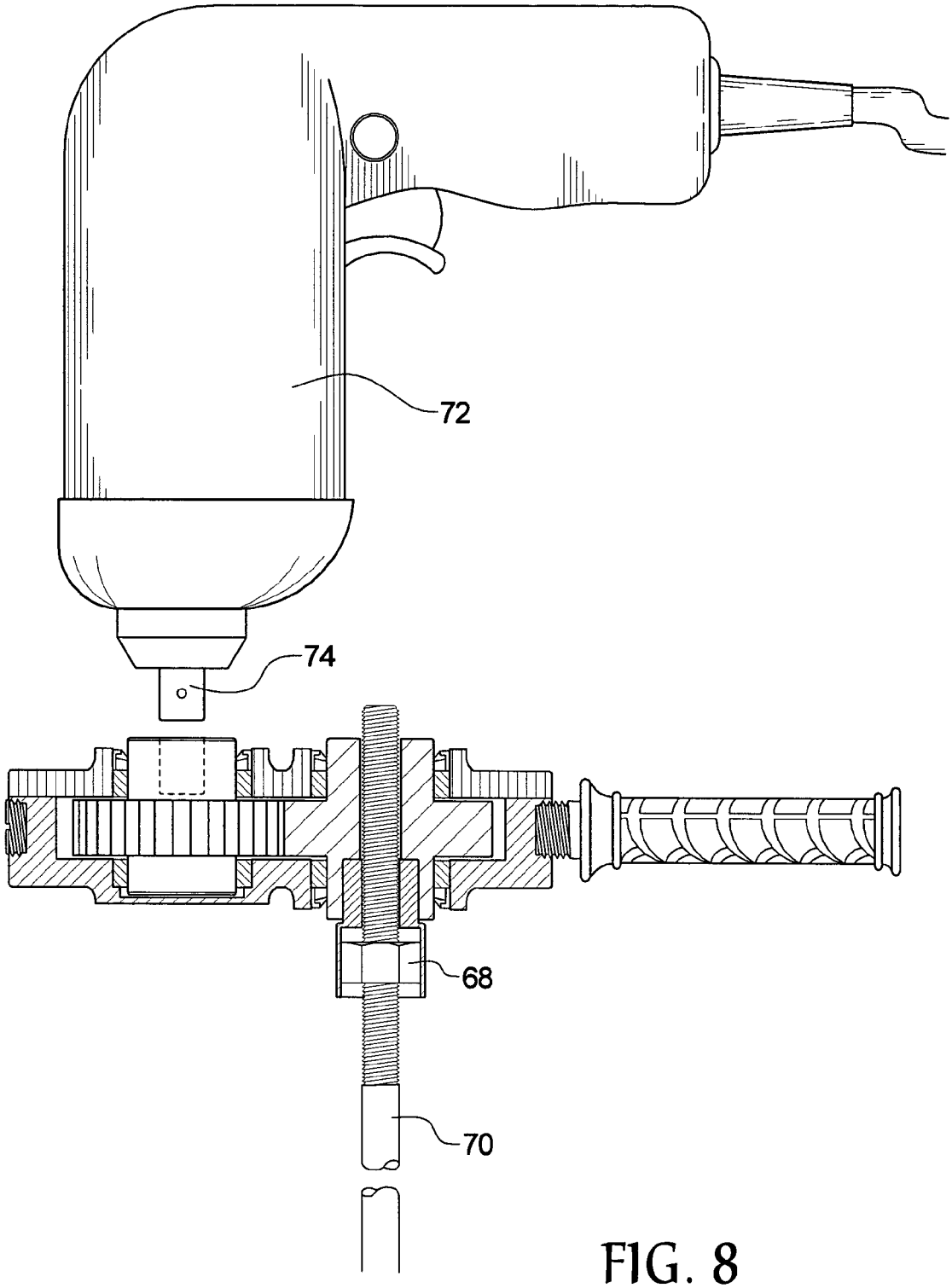
FIG. 8 is an environmental view, partially sectioned, of the offset socket drive being utilized on a nut disposed on a long stud.
Figure 9:
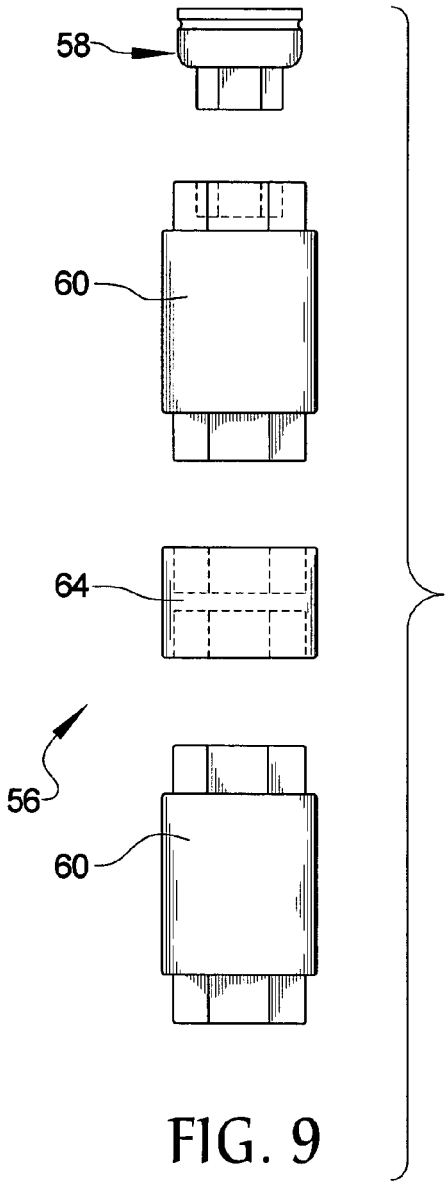
FIG. 9 is an view of the extension system of the offset socket drive in an exploded configuration.
Figure 10:
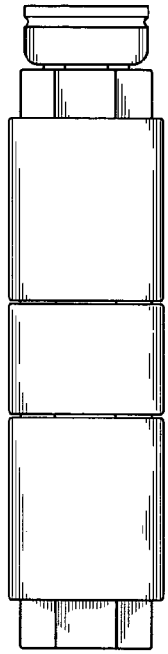
FIG. 10 is an view of the extension system of the offset socket drive in an assembled configuration.
Figure 11:
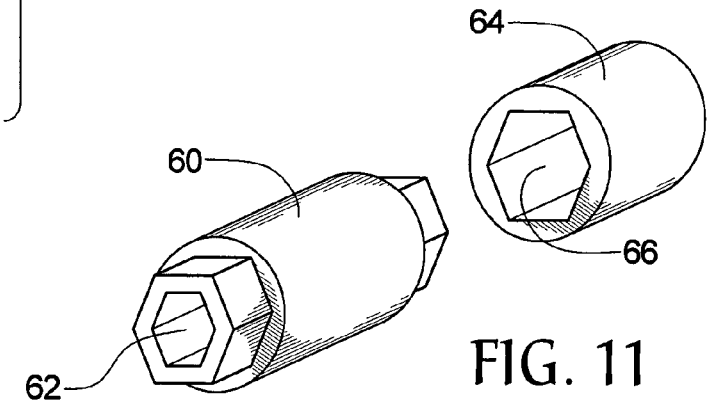
FIG. 11 is a perspective view of a pair of the components of the extension system.
Figure 12:
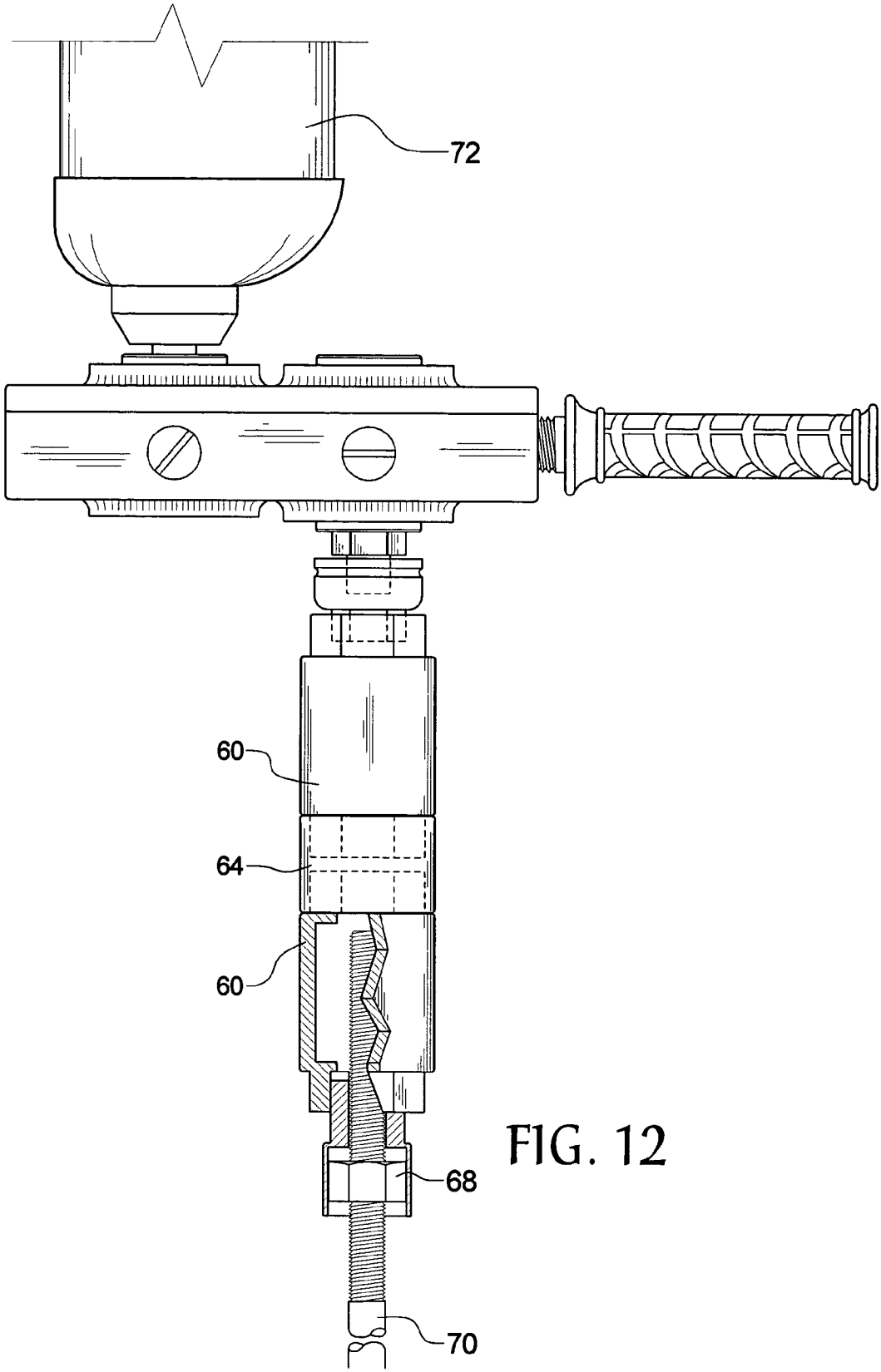
FIG. 12 is an environmental view, partially sectioned, of the offset socket drive being utilized with the extension system.

Referring now to the drawings, it is seen that the offset socket drive, generally denoted by reference numeral 10, is comprised of a body member 12 that is a generally rectangular member that has a top plate 14, a bottom 16, and a plurality of sides 18 joining the top plate 14 and the bottom 16. The top plate 14 may be separable from the remainder of the body member 12 in order to allow access into the interior chamber of the body member 12. The top plate 14 is attached to the remainder of the body member 12 by appropriate screws 20. One or more threaded receptacles 22 are located on one or more sides 18 of the body member 12, such that the threaded receptacles 22 threadably receive a handle 24 therein. A threaded cap 26 is threadably received within each threaded receptacle 22 whenever such receptacle 22 is not in receipt of the handle 24. An oil fill opening that has an appropriate hex nut 28 or other closure device is provided on the body member 12 for introducing oil into the interior chamber of the body member 12. The oil fill opening is located equidistant from each of the opposing short sides 18 of the body member 12 so that the body member 12 may be stood on either of these sides 18 in order to check the internal oil level within the body member. The oil introduced into the interior chamber of the body member via the oil fill opening provides appropriate lubrication for the internal gearing of the device 10. As oil is more viscous than grease, the use of oil makes turning of the drive gear 30 and thus the driven gear 34 (each discussed below) relatively easier. Additionally, each gear 30 and 34 (and any intermediate gears, if used) are rotatably disposed within the body member 12 via appropriate bearings, which bearings may be brass bearings in order to further help facilitate smooth rotation of the gears.

A drive gear 30 is rotatably disposed within the body member 12, the drive gear having a square drive recess 32. A driven gear 34 is also rotatably disposed within the body member 12. The driven gear 34 is gearably connected with the drive gear 30 such that rotation of the drive gear 30 causes rotation of the driven gear 34. This gearable connection between drive gear 30 and driven gear 34 can be a direct connect, as illustrated, or may have one or more intermediate gears disposed between the drive gear 30 and the driven gear 34. The gear ration between drive gear 30 and driven gear 34 may be one-to-one, less than one-to-one, or more than one-to-one depending on the desired applications of the device 10. The driven gear 34 has a hex receptacle 36 that has a first longitudinal hollow core passing therethrough. The square recess 32 of the drive gear 30 faces in opposing direction relative to the hex receptacle 36 of the driven gear 34. Appropriate oil seals 40 are located about the drive gear 30 and the driven gear 34.

A socket 42 is received within the hex receptacle 36 of the driven gear 34. As seen, the socket 42 is a typical socket that has a hex end 44 and a working end 46, the socket 42 having a second longitudinal hollow core 48. The socket 42 is connected to the hex receptacle 36 of the driven gear 34 by having the hex head 44 of the socket 42 received within the hex receptacle 36 of the driven gear 34, thereby aligning the first hollow core 38 of the driven gear 34 with the second hollow core 48 of the socket 42. Alternately, the socket 42' may be connected to the hex receptacle 36 via a hex-to-square adapter 50 that has a hex head 52 that is received within the hex receptacle 36 and a square head 54 that snaps into the socket 42' The hex-to-square adapter 50 may also have a hollow core (not illustrated) such that when the socket 42 is connected to the hex receptacle 36 via the hex-to-square adapter 50, all of the hollow cores longitudinally align.

The socket 42 may be connected to the hex receptacle 36 of the driven gear 34 by an extension system 56. As seen, the extension system 56 is comprised of a hex-to-square adapter 50 that is received within the hex receptacle 36 in the usual way. A hex adapter 58 is attached to the square head 54 of the hex-to-square adapter 50. A cylinder 60 having a hollow core 62 is attached to the hex adapter 58. If desired, a coupler 64, also having a hollow core 66, is attached to the end of the cylinder 60 (the end opposite the end that is attached to the hex adapter 58) and a second cylinder 60 is attached to the coupler 64. Additional cylinders 60 can be attached in similar fashion. The outer diameter of the each cylinder 60 and the coupler 64 is substantially similar so that a user that grasps the extension system 56 proximate the coupler 64 cylinder 60 boundary will have a relatively smooth feel as the extension rotates within the user's hand.

In order to use the offset socket drive 10 of the present invention, a handle 24 is threadably received within a desired one of the threaded receptacles 22. The handle 24 is positioned in the particular receptacle 22 that gives the user the best grip in light of the job and the various clearances that are available. If desired, more than one handle 24 can be utilized. A socket 42 is connected to the hex receptacle 36 of the driven gear, either directly, via the hex-to-square adapter 50, or via the extension system 56. The socket 42 is positioned onto a desired nut 68 or bolt. As the driven gear 34 has a hollow receptacle 38 and the socket 42 also has a hollow core 48, the aligned hollow cores 38 and 48 allow a long stud 70 upon which the nut 68 may be located to pass through the hollow cores 38 and 48 thereby permitting the socket 42 to be received on the nut 68. If the socket 42 uses the hex-to-square adapter 50, either the hex-to-square adapter 50 has a hollow core 38 that aligns with the hollow core 38 of the driven gear 34 in order to allow the stud to pass through the aligned hollow cores of the socket 42', the hex-to-square adapter 50 and the driven gear 34, or the socket 42' is sufficiently deep so that the socket 42' can gain working access to the nut 68. If the extension system 56 is utilized, the hollow core 62 of the cylinder 60 and the hollow core 66 of the coupler 64 also allow the stud 70 to pass therethrough in order to provide working access of the socket 42 with the nut 68. An impact driver 72 is positioned such that its drive head 74 is received within the square recess 32 of the drive gear 30. The impact driver 72 is activated, causing its drive head 74 to rotate, which rotates the drive gear 30, which rotates the driven gear 34, which rotates the socket 42, thereby working on the nut 68 or bolt.

If working access into the interior chamber of the body member 12 is required, the top plate 16 is removed by removing its screws 20 and work is performed within the body member 12. Thereafter the top plate 16 is reattached to the body member 12.

While the invention has been particularly shown and described with reference to an embodiment thereof, it will be appreciated by those skilled in the art that various changes in form and detail may be made without departing from the spirit and scope of the invention.

I claim:

1. An offset socket drive comprising:

a body member;

a drive gear having a square recess adapted to receive the drive head of an impact driver, the drive gear rotatably disposed within the body member;

a driven gear having a hex receptacle, the driven gear rotatably disposed within the body member and gearably meshed with the drive gear, the driven gear having a first longitudinal hole core;

a socket having a second longitudinal core, the socket being connected to the hex receptacle such that the first hollow core and the second hollow core longitudinally align;

at least one threaded receptacle located on a side of the body member;

a handle that is threadably received within a respective one of the at least one threaded receptacle;

at least one cap that is threadably received within the at least one threaded receptacle whenever the threaded receptacle does not receive the handle; and wherein the impact driver is activated causing the drive head to rotate thereby causing the drive gear to rotate which causes the driven gear and the received socket to rotate.

2. The offset socket drive as in claim 1 further comprising an oil fill opening located on the body member for introducing grease into the body member and onto the drive gear and the driven gear.

3. The offset socket as in claim 1 wherein the square recess faces in an opposite direction relative to the facing of the hex receptacle.

4. The offset socket drive as in claim 1 wherein the socket is connected to the hex receptacle via a hex-to-square adapter that is received within the hex receptacle and the socket is received thereonto.

5. The offset socket drive as in claim 4 wherein the socket is connected to the hex receptacle via an extension.

6. The offset socket drive as in claim 5 wherein the extension comprises:

a hex-to-square adapter that is received within the hex receptacle;

a hex drive adapter that is received on the hex-to-square adapter; and a cylinder that is received on the hex drive adapter such that the socket is received by the cylinder.

7. The offset socket drive as in claim 6 wherein the cylinder has a third hollow core such that the first hollow core, second hollow core, and the third hollow core all longitudinally align whenever the socket is connected with the hex receptacle via the extension.

8. The offset socket drive as in claim 5 wherein the extension comprises:

a hex-to-square adapter that is received within the hex receptacle;

a hex drive adapter that is received on the hex-to-square adapter; and a first cylinder that is received on the hex drive adapter;

a coupler attached to the first cylinder; and a second cylinder attached to the coupler such that the socket is received by the second cylinder.

9. The offset socket drive as in claim 8 wherein the first cylinder and the second cylinder each have a third hollow core and the coupler has a fourth hollow core such that the first hollow core, second hollow core, the third hollow core, and the fourth hollow core all longitudinally align whenever the socket is connected with the hex receptacle via the extension.

10. An offset socket drive comprising:

a body member;

a drive gear having a square recess adapted to receive the drive head of an impact driver, the drive gear rotatably disposed within the body member;

a driven gear having a hex receptacle, the driven gear rotatably disposed within the body member and gearably meshed with the drive gear, the driven gear having a first longitudinal hole core;

a socket having a second longitudinal core, the socket being connected to the hex receptacle such that the first hollow core and the second hollow core longitudinally align;

at least one threaded receptacle located on a side of the body member;

a handle that is threadably received within a respective one of the at least one threaded receptacle;

at least one cap that is threadably received within the at least one threaded receptacle whenever the threaded receptacle does not receive the handle; and wherein the impact driver is activated causing the drive head to rotate thereby causing the drive gear to rotate which causes the driven gear and the received socket to rotate and wherein the socket is connected to the hex receptacle via a hex-to-square adapter that is received within the hex receptacle and the socket is received thereonto.

11. The offset socket drive as in claim 10 further comprising an oil fill opening located on the body member for introducing grease into the body member and onto the drive gear and the driven gear.

12. The offset socket as in claim 10 wherein the square recess faces in an opposite direction relative to the facing of the hex receptacle.

13. The offset socket drive as in claim 10 further comprising a handle removably attached to the body member.

14. The offset socket drive as in claim 10 wherein the socket is connected to the hex receptacle via an extension.

15. The offset socket drive as in claim 14 wherein the extension comprises:

a hex-to-square adapter that is received within the hex receptacle;

a hex drive adapter that is received on the hex-to-square adapter; and a cylinder that is received on the hex drive adapter such that the socket is received by the cylinder.

16. The offset socket drive as in claim 15 wherein the cylinder has a third hollow core such that the first hollow core, second hollow core, and the third hollow core all longitudinally align whenever the socket is connected with the hex receptacle via the extension.

17. The offset socket drive as in claim 14 wherein the extension comprises:

a hex-to-square adapter that is received within the hex receptacle;

a hex drive adapter that is received on the hex-to-square adapter; and a first cylinder that is received on the hex drive adapter;

a coupler attached to the first cylinder; and a second cylinder attached to the coupler such that the socket is received by the second cylinder.

18. The offset socket drive as in claim 17 wherein the first cylinder and the second cylinder each have a third hollow core and the coupler has a fourth hollow core such that the first hollow core, second hollow core, the third hollow core, and the fourth hollow core all longitudinally align whenever the socket is connected with the hex receptacle via the extension.

* * * * *